US005133161A

United States Patent [19]

Reas

[11] Patent Number: 5,133,161

[45] Date of Patent: Jul. 28, 1992

[54] PAINT LINE CLEANING SYSTEM

[75] Inventor: Richard L. Reas, Hesperia, Mich.

[73] Assignee: Robo Clean, Inc., Hesperia, Mich.

[21] Appl. No.: 478,419

[22] Filed: Feb. 12, 1990

[51] Int. Cl.[5] ..... B24C 3/08

[52] U.S. Cl. ..... 51/417; 51/418; 51/426

[58] Field of Search ..... 51/410, 417, 418, 426, 51/427

[56] References Cited

U.S. PATENT DOCUMENTS

| | | | |
|---|---|---|---|
| 2,037,047 | 4/1936 | Rosenberger . | |
| 2,239,714 | 4/1941 | Hammel | 51/418 |
| 2,240,248 | 4/1941 | Turnbull | 51/418 |
| 2,250,500 | 7/1941 | Rosenberger | 51/418 |
| 2,344,475 | 3/1944 | Turnbull | 51/418 |
| 2,510,927 | 6/1950 | Hayett | 51/418 |
| 2,624,982 | 1/1953 | VanderWal | 51/418 |
| 3,031,802 | 5/1962 | Leliaert . | |
| 3,284,828 | 11/1966 | Jennings . | |
| 3,454,150 | 7/1969 | Johnson . | |
| 3,830,196 | 8/1974 | Guttman et al. . | |
| 3,854,439 | 12/1974 | Harmuth . | |
| 3,909,289 | 9/1975 | Foucart et al. . | |
| 4,031,666 | 6/1977 | West | 51/418 |
| 4,069,790 | 1/1978 | Witte . | |
| 4,137,344 | 1/1979 | Lasne et al. . | |
| 4,355,488 | 10/1982 | Schmitz et al. | 51/319 |
| 4,897,969 | 2/1990 | Balhorn | 51/418 |

FOREIGN PATENT DOCUMENTS

| | | | |
|---|---|---|---|
| 0032461 | 7/1981 | European Pat. Off. | 51/418 |

OTHER PUBLICATIONS

GMF Robotics-ARC Mate, 1988.
GMF Robotcs-S-10, 1988.

*Primary Examiner*—Bruce M. Kisliuk
*Assistant Examiner*—John A. Marlott
*Attorney, Agent, or Firm*—Price, Heneveld, Cooper, DeWitt & Litton

[57] ABSTRACT

A paint line cleaning system includes an elongated enclosure or housing having an inlet and an outlet. A nozzle is supported within the housing. The nozzle is connected to a source of cleaning media. The nozzle is positioned by a programmable robot. A pair of door sets mounted on the enclosure open and close the inlet and outlet. A portion of the paint line system to be cleaned may pass into the enclosure and the nozzle is positioned so that the cleaning media removes paint and the like.

8 Claims, 2 Drawing Sheets

PAINT LINE CLEANING SYSTEM

BACKGROUND OF THE INVENTION

The present invention relates to cleaning apparatus, and more particularly to a unique device for cleaning portions of overhead paint line systems.

Continuous paint line systems, as used in many industries, typically include an overhead conveyor from which a plurality of support hooks or carries are suspended. Parts racks or hangers are positioned on the support hooks. The support hooks carry the parts racks through the paint line enclosures. Over a period, the hooks become coated with paint. With electrostatic painting systems, the paint build up on the carriers interferes with the electric current flow. This may result in improper paint adhesion. The carriers must be removed and cleaned at regular intervals. The cleaning procedures may involve cleaning the carriers or hooks in solvent. Such a manual cleaning process involves considerable expense, lengthy down time and is labor intensive.

In an attempt to overcome problems with manual cleaning of components of the paint line systems, at least one in-line cleaning system has been developed. The system includes an oven which is positionable along the paint line system. The oven employs a plurality of gas burners which remove the paint from the support hooks by burning the paint to ash. The hooks are subsequently washed to remove the ash. An example of such a system may be found in U.S. Pat. No. 3,830,196 entitled CLEANING PAINT HOOKS and issued on Aug. 20, 1974 to Guttman et al.

Presently available cleaning methods suffer from inherent problems relating to cost, operability and the like. For example, burnoff furnaces inherently present safety and combustion product removal problems.

A need exists, therefore, for a paint line cleaning system which effectively cleans the support hooks or carriers without excessive hazard to personnel and which permits ready collection and disposal of chips, dust and debris.

SUMMARY OF THE INVENTION

In accordance with the present invention, the aforementioned needs are fulfilled. Essentially, a paint line cleaning system is provided which includes a housing or enclosure. Provision is made for closing off the housing while a support hook or other member of the paint line system is disposed therein. A nozzle is connected to a source of cleaning media. Provision is made for positioning the nozzle within the enclosure to clean the support hook thoroughly. In narrower aspects of the invention, provision is made for removing paint chips and dust from the enclosure and directing it to a suitable disposal container.

The apparatus in accordance with the present invention eliminates problems heretofore associated with excessive heat, disposal of contaminants, removal of burn off products and the like. The device may be permanently placed in position on the paint line. The apparatus reduces maintenance costs and improves paint line system operation.

DETAILED DESCRIPTION OF THE PREFERRED EMBODIMENT

Figure 1:
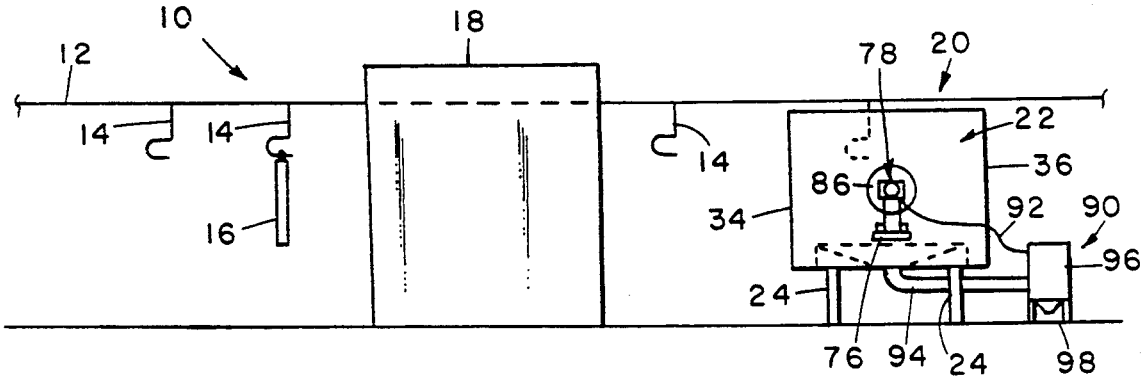
FIG. 1 is a schematic, side elevational view of the paint line system incorporating a device in accordance with the present invention.

A continuous electrostatic paint line system is schematically illustrated in FIG. 1 and generally designated by the numeral 10. System 10 includes an overhead conveyor 12. A plurality of support hooks 14 are suspended from conveyor 12. A parts rack or hanger 16 may be suspended from each hook 14. Conveyor 12 transports the racks and hooks through a paint enclosure 18. A typical system defines a loading zone, a pretreatment zone, a painting zone, a heat drying zone, a cooling zone and an unloading zone. Over time, the hooks 14 become coated with paint. Such coating has a negative effect on painting operations.

In accordance with the present invention, a device 20 is provided for cleaning portions of the overhead paint line. Device 20 includes an enclosure or housing 22 supported on legs 24 downstream of paint enclosure 18. In the alternative, housing 22 could be permanently hung in position on the paint line system.

Figure 2:
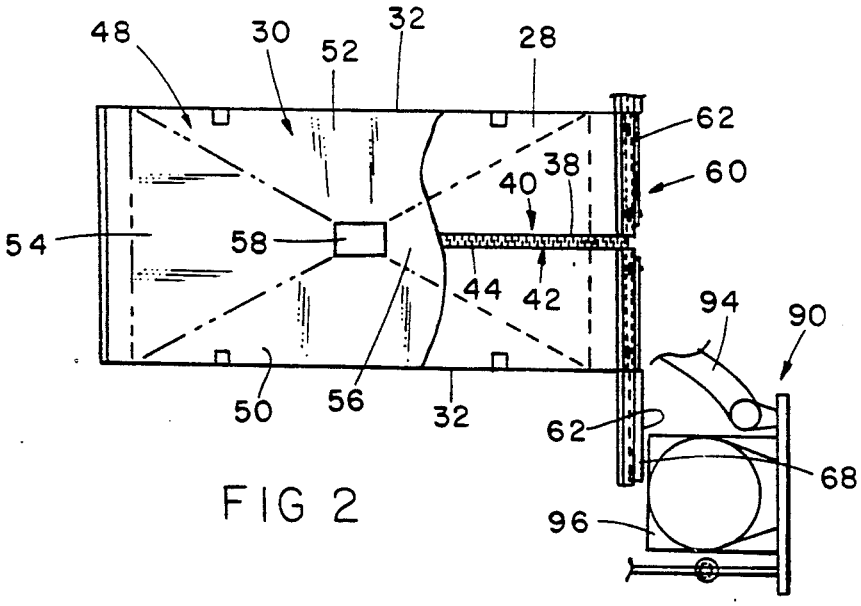
FIG. 2 is a top plan view of a housing or enclosure incorporated in a device in accordance with the present invention and taken generally along line II—II of FIG. 1.
Figure 3:
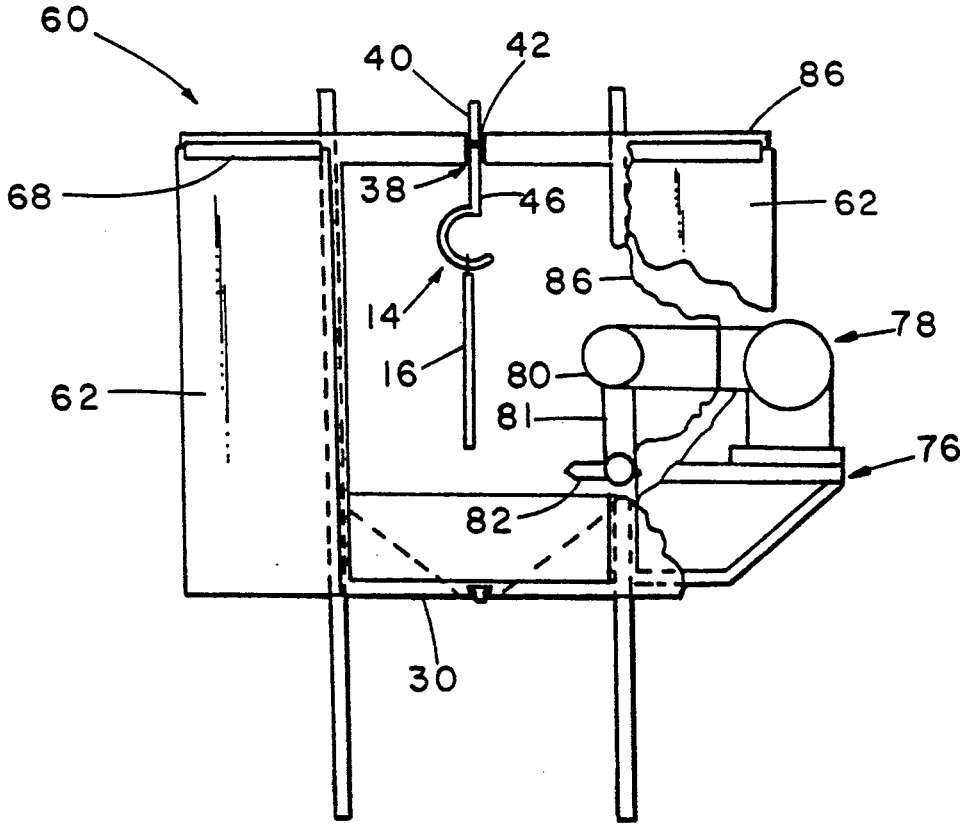
FIG. 3 is a partial, end elevational view of the device in the present invention.

Housing 22 includes a top 28, a bottom section 30, sides 32, an inlet end 34 and an outlet end 36. Top 28 of housing 22 defines an elongated slot 38 (FIGS. 2 and 3). A pair of opposed wire or plastic brushes 40, 42 having bristles 44 extend along and seal the length of slot 38. Support hook 14, suspended from overhead conveyor 12, includes a shank 46. As shown in FIG. 3, shank 46 passes through slot 38 as hook 14 is moved through enclosure 22. The enclosure is dimensioned to permit the hook and rack to pass therethrough The enclosure may be left permanently in the paint line.

Bottom section 30 of enclosure 22 supports a bin or hopper 48 which includes sides 50, 52, 54, 56. The sides converge to a discharge opening 58. Bin 48, as described below, collects the shot or cleaning media and removed paint.

Figure 4:
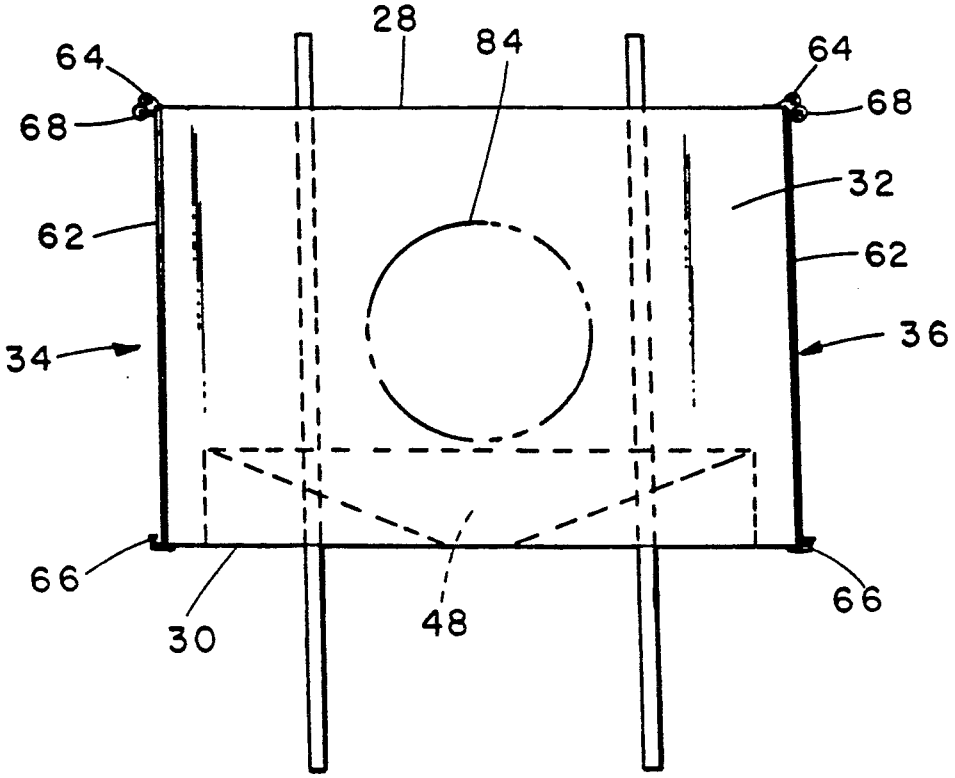
FIG. 4 a side elevational view of the device.

As seen in FIGS. 2 and 4, ends 34 and 36 are closed with door sets 60. Each set 60 includes door members 62 slidably mounted on upper tracks 64 and lower tracks 66 (FIG. 4). Commercially available, door actuators 68 shift members 62 from a closed position to an open position as shown in FIG. 3. The actuators may be conventional pneumatic piston/cylinder devices. In the alternative, hinged doors or a vertical, plastic curtain "doors" could be used. The doors should close off the ends sufficiently to contain the cleaning media, dust and debris.

A robot mount 76 is secured to a side of enclosure 22. A programmable robot 78 (FIG. 3) is positioned on mount 76. Robot 78 includes arms 80, 81. A blast nozzle 82 is mounted on arm 81. Side 32 of enclosure 22 defines a robot access aperture or window 84 (FIG. 2) through which arms 80, 81 of robot 78 extend. The window is sealed with a flexible boot 86 (FIG. 3). Boot 86 retains cleaning media within the enclosure yet permits full movement of the robot arms. It is presently preferred that robot 78 be a programmable, unit having at least six controlled axes. Commercially available units include those sold by GMF Robotics Canada, Ltd. or GMF Robotics Europe (GmbH). As should be apparent, robot 78 positions nozzle 82 within the housing around a hook 14 and/or rack 16. In the alternative, a free standing robot could be positioned adjacent the enclosure with the arms thereof extending into and through the aperture.

A combination cleaning media source, sorter separator and vacuum system 90 is positioned adjacent the enclosure. In the preferred form, device 90 includes a shot thrower connected to nozzle 82 by a line 92. Blasting media or shot is used to clean the support hooks. Device 90 also includes a dust and chip collector including a blower having a duct 94 connected to outlet 58 of bin 48. The blower draws a vacuum within the enclosure which removes media and debris to a cyclone separator 96. Debris exits outlet 98 and into a disposal container. The cleaning media is reused. While a shot blasting process is presently preferred for cleaning paint line systems, other cleaning media could be used in different applications.

OPERATION

Device 20 is permanently mounted in-line on the paint line system. During normal paint operations, door member 62 is open. As a result, support hooks 14 and part racks 16 may pass through device 20 without interference. When it becomes necessary to clean removed paint from support hooks 14, conveyor 12 is advanced in a step-wise fashion to position a hook 14 within the enclosure. As the hook passes into and out of the enclosure, brushes 40, 42 contact and scrape the shank 46. Doors 62 of each door set 60 are closed. The shot thrower of device 90 is actuated and shot is supplied through line 92 to nozzle 82. Robot 78 moves nozzle 82 within the enclosure. The shot or other cleaning media thoroughly cleans support hook 14. The shot and debris are collected in bin 48 in the lower portion of the enclosure and returned to device 90 for separation and recycling of the shot. The shot is reused until it is determined that it should be changed. Actuators 68 are timed so that the doors are closed while hook 14 is positioned within the housing. The vacuum drawn in duct 94 effectively removes dust and debris from the enclosure. Debris is controlled and directed to a disposal container in a closed system.

The system in accordance with the present invention effectively and efficiently cleans the hooks. Problems heretofore experienced with burn off systems and with the use of solvents are eliminated. The system is mounted in line. Minimal down time results during cleaning operations. The overall efficiency of the paint line system is increased.

In view of the foregoing description, those of ordinary skill in the art may envision various modifications which would not depart from the inventive concepts disclosed herein. As a result, the above should be considered as only that of the preferred embodiment. The true spirit and scope of the present invention ma be determined by reference to the appended claims.

The embodiments of the invention in which an exclusive property or privilege is claimed are defined as follows:

1. An apparatus for cleaning portions of overhead paint line systems of the type having an overhead conveyor and a plurality of support hooks from which parts racks are suspended, said apparatus comprising:

a housing having an inlet end, an outlet end, a top, a bottom, and sides, said top defining an elongated slot extending between said ends and wherein said housing is dimensioned to permit the hooks and racks to pass therethrough and the housing may be left permanently in-line on the paint line;

inlet door means on said housing for opening and closing said inlet end;

outlet door means on said housing for opening and closing said outlet end;

a nozzle;

supply means operatively connected to said nozzle for supplying a cleaning media to said nozzle;

programmable nozzle positioning means connected to said nozzle for programmably positioning said nozzle within said housing;

debris collection means connected to said housing for removing debris from within said housing; and a pair of opposed, parallel, elongated brushes extending along said slot for brushing debris from the hooks.

2. A device for removing paint from support hooks of overhead paint line systems, said hooks having a shank portion attached to an overhead conveyor, said device comprising:

an elongated enclosure having sides, a bottom, a top and ends;

support means on said enclosure for positioning said enclosure in a paint line so that the support hooks may be moved through the enclosure;

programmable cleaning media means connected to said enclosure for cleaning said support hooks while in said enclosure to remove paint therefrom, said cleaning media means including a nozzle and programmable positioning means supporting the nozzle for moving the nozzle within the enclosure and around the hook to clean the hooks;

closure means on said enclosure for closing said enclosure when a support hook is within the enclosure;

wherein said enclosure defines an elongated slot and said device further includes an elongated brush extending along said slot to engage the shank of the support hook for brushing debris therefrom.

3. An apparatus for cleaning portions of overhead paint line systems of the type having an overhead conveyor and a plurality of support hooks from which parts racks are suspended, said apparatus comprising:

a housing having an inlet end, an outlet end, a top, a bottom and sides, said top defining an elongated slot extending between said ends and wherein said housing is dimensioned to permit the hooks and racks to pass therethrough and the housing may be left permanently in-line on the paint line;

inlet door means on said housing for opening and closing said inlet end;

outlet door means on said housing for opening and closing said outlet end;

a nozzle;

supply means operatively connected to said nozzle for supplying a cleaning media to said nozzle;

programmable nozzle positioning means connected to said nozzle for programmably positioning said nozzle within said housing;

debris collection means connected to said housing for removing debris from within said housing, said housing supporting a bin having a discharge outlet, said supply means comprising:

a shot blast thrower; and a line connected between said thrower and said nozzle, said nozzle positioning means comprising a programmable multi-axis robot; and a pair of opposed, parallel, elongated brushes extending along said slot for brushing debris from the hooks.

4. An apparatus as defined by claim 3 wherein said inlet and said outlet door means each comprise:

a door set, each door set including a pair of door members and mounting means for movably mounting the members on said housing.

5. An apparatus as defined by claim 4 wherein said inlet and outlet door means each include door actuator means for opening and closing said doors.

6. A device for removing paint from support hooks of overhead paint line systems, said hooks having a shank portion attached to an overhead conveyor, said device comprising:

an elongated enclosure having sides, a bottom, a top and ends;

support means on said enclosure for positioning said enclosure in a paint line so that the support hooks may be moved through the enclosure;

programmable cleaning media means connected to said enclosure for cleaning said support hooks while in said enclosure to remove paint therefrom, said cleaning media means including a nozzle and programmable positioning means supporting the nozzle for moving the nozzle within the enclosure and around the hook to clean the hooks;

closure means on said enclosure for closing said enclosure when a support hook is within the enclosure, said closure means comprising a pair of door sets, each set mounted at one end of the enclosure, closure means further including door actuator means connected to said door sets for opening and closing said doors, said cleaning media means comprising: a nozzle, shot means connected to said nozzle for supplying shot under pressure to said nozzle, and positioning means supporting said nozzle for moving said nozzle within said enclosure to clean said hook; and wherein said enclosure defines an elongated slot and said device further includes an elongated wire brush extending along said slot to engage the shank of the support hook for brushing debris therefrom.

7. A device as defined by claim 6 further including:

dust and chip collection means connected to said enclosure for removing dust and paint chips from said enclosure.

8. A device as defined by claim 7 wherein said dust and chip collection means comprises a blower having an inlet connected to said enclosure.

* * * * *

UNITED STATES PATENT AND TRADEMARK OFFICE

CERTIFICATE OF CORRECTION

PATENT NO. : 5,133,161

DATED : July 28, 1992

INVENTOR(S) : Richard L. Reas

It is certified that error appears in the above-identified patent and that said Letters Patent is hereby corrected as shown below:

Column 3, line 62;

"ma" should be --may--.

Column 4, Claim 2, after line 42 and before line 43

After "enclosure" insert --dust and chip collection means connected to said enclosure for removing debris from said enclosure; and--.

Column 6, Claim 6, Line 8;

After "enclosure" insert --and having doors positioned on said enclosure--.

Signed and Sealed this

Second Day of November, 1993

*Attest:*

*Attesting Officer*

Bruce Lehman

BRUCE LEHMAN

*Commissioner of Patents and Trademarks*